US007739972B2

(12) United States Patent
Sturm et al.

(10) Patent No.: US 7,739,972 B2
(45) Date of Patent: Jun. 22, 2010

(54) METHOD AND APPARATUS FOR PRODUCING A SEWN PRODUCT

(75) Inventors: Christian Sturm, Krefeld (DE); Christian Koster, Neustadt (DE); Klaus Stutznäcker, Frechen (DE)

(73) Assignee: Nahmaschinenfabrick Emil Stutznäker GmbH & Co. KG, Köln (DE)

( * ) Notice: Subject to any disclaimer, the term of this patent is extended or adjusted under 35 U.S.C. 154(b) by 0 days.

(21) Appl. No.: 12/028,537

(22) Filed: Feb. 8, 2008

(65) Prior Publication Data

US 2008/0216726 A1 Sep. 11, 2008

(30) Foreign Application Priority Data

Feb. 9, 2007 (DE) ..... 10 2007 007 146
Mar. 16, 2007 (DE) ..... 10 2007 012 621

(51) Int. Cl.
*D05B 11/00* (2006.01)
*B26D 1/60* (2006.01)

(52) U.S. Cl. ..... 112/475.08; 112/117; 112/122.3; 83/938

(58) Field of Classification Search ..... 112/102, 112/117, 118, 122–129, 152, 470.33, 475.08; 83/938

See application file for complete search history.

(56) References Cited

U.S. PATENT DOCUMENTS

| | | | | |
|---|---|---|---|---|
| 3,670,679 | A * | 6/1972 | Campbell | 112/475.06 |
| 3,785,307 | A * | 1/1974 | Hunter et al. | 112/470.33 |
| 4,594,955 | A * | 6/1986 | Lichtenberg | 112/147 |
| 4,883,009 | A * | 11/1989 | Haselberger et al. | 112/475.18 |
| 5,040,473 | A * | 8/1991 | Zesch et al. | 112/117 |
| 5,913,277 | A * | 6/1999 | Resta | 112/470.12 |
| 6,293,213 | B1 * | 9/2001 | Block et al. | 112/470.05 |
| 6,408,773 | B2 * | 6/2002 | Resta | 112/2.1 |
| 7,066,101 | B2 * | 6/2006 | Codos | 112/117 |

FOREIGN PATENT DOCUMENTS

WO WO 99/19552 A1 4/1999

* cited by examiner

*Primary Examiner*—Ismael Izaguirre
(74) *Attorney, Agent, or Firm*—Jones & Smith, LLP

(57) ABSTRACT

The present invention relates to a simple and inexpensive method for producing a mattress panel or quilt having corners which deviate from an orthogonal pattern. The method renders a material having two stitched seams between two sewn products that are arranged adjacently. The two stitched seams are created by a sewing device, which moves transversely to the conveying direction of the material. The material is cut between said seams by a sewing unit, located within the sewing device. Prior to or during the stitching of the seams, another device removes a sub-area comprising both sewn products, resulting in a mattress panel or quilt with corners deviating from an orthogonal pattern.

32 Claims, 11 Drawing Sheets

METHOD AND APPARATUS FOR PRODUCING A SEWN PRODUCT

Figure 1:
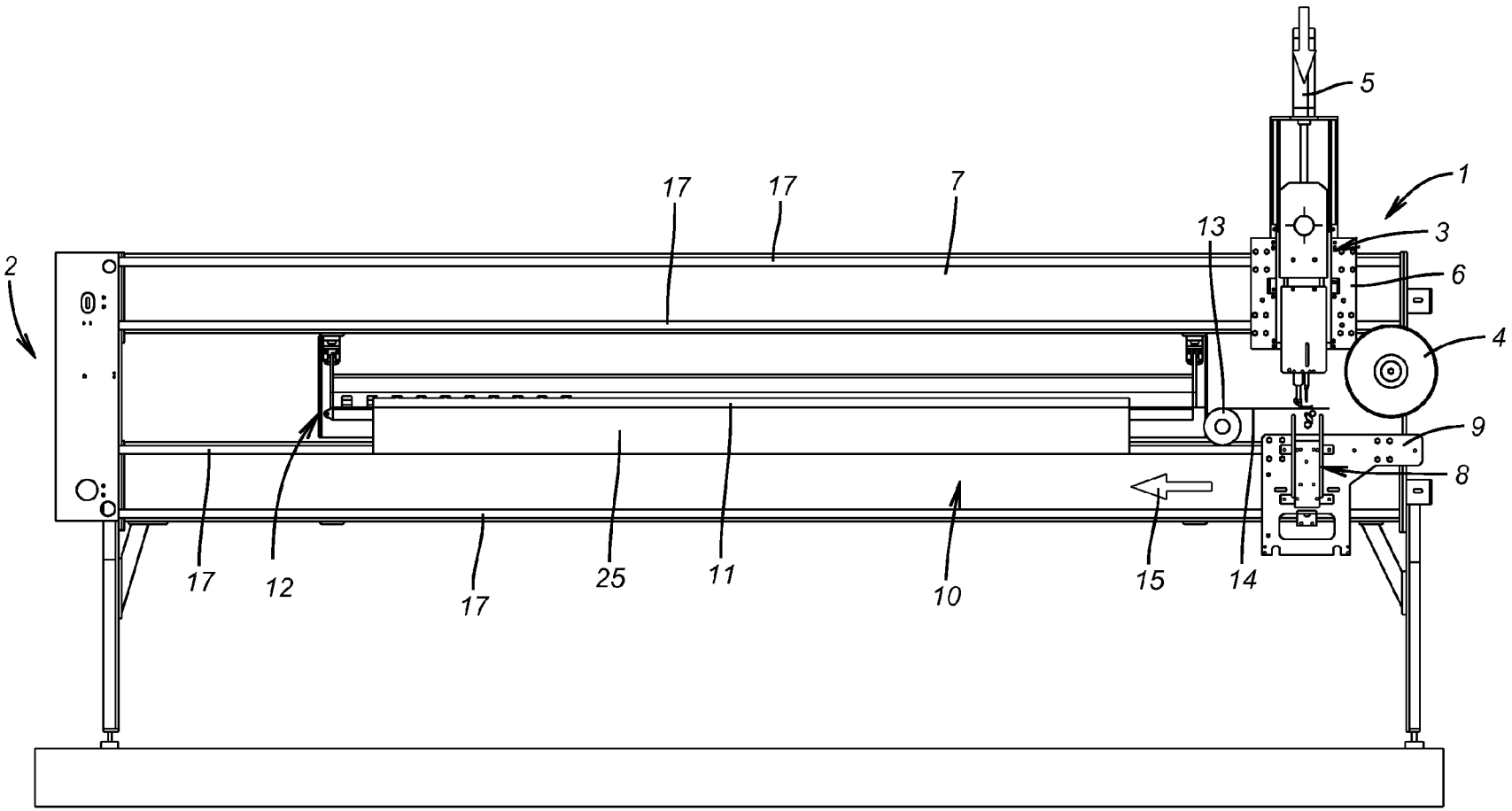

The present invention relates to a method for producing a sewn product, especially a mattress panel, a quilt or the like, having corner areas which deviate from an orthogonal pattern, preferably consisting of several layers of sewn product material which are to be stitched together, as a segment of a sewn product material, in which method the sewn product material is provided with at least two stitched seams between two sewn products that are arranged adjacent to each other in the sewn product material, by means of a sewing device which is movable transversely to the conveying direction of the sewn product material, and in which the sewn product material is subsequently cut between the two stitched seams, wherein the sewing device includes a sewing unit with needles and an oscillating shuttle box including shuttles which are assigned to the needles. The invention further relates to an apparatus, especially a multiple needle sewing machine, preferably a multiple needle chain stitch sewing machine or a multiple needle backstitch sewing machine, for the production of a sewn product, especially a mattress panel, a quilt or the like, having corner areas that deviate from an orthogonal pattern, preferably from several layers of sewn product material which are to be stitched together, as a segment of a sewn product material, comprising a sewing device which is movable transversely to the conveying direction of the sewn product material and which includes a sewing unit with needles and with a shuttle box having shuttles which are assigned to the needles.

From prior art methods for producing a sewn product are known. The term sewn product is understood to mean for instance mattress cloth, especially mattress cover and/or side panels, quilts or the like. Mattress cloth is used for covering mattress cores, and this sewn product consists especially of a face fabric and a filler, e.g. of a foamed material, which materials are stitched together. Between adjacently arranged sewn products the beginnings or the ends of the sewn products are sewn up with at least two, preferably four or more stitched seams transversely to the conveying direction of the sewn product material. Thereafter, the sewn product material is cut between the stitched seams.

Moreover, from the document EP 1 120 486 B1 a device for the production of a sewn product is known, in which the sewn product material is withdrawn from a supply device and is fixed in a clamping frame. The clamping frame is provided with a traverse above the clamping frame, which traverse extends transversely to the conveying direction of the sewn product material and is movable relative to the clamping frame in the conveying direction of the sewn product material, with a sewing unit being movable on said traverse. With this device for producing a sewn product backstitches are performed, by means of which the sewn product material is stitched together while stitching various patterns which are stored for instance in a computer system and which may be fetched for controlling the sewing unit.

The sewn product material may be continuously withdrawn from the supply device and fed to the clamping frame. The clamping frame consists of two clamping devices that extend transversely to the conveying direction of the sewn product material and two clamping elements that are arranged on the longitudinal rims of the sewn product material and extend in the conveying direction and are movable transversely to the conveying direction.

After loose sewn product material is supplied to the clamping frame and clamped therein, the clamped part of the sewn product material may be provided with the desired backstitches, while a substantially straight stitched seam is produced respectively along the clamping device or the clamping elements.

After the stitching operation is concluded, trimming of the rims of the sewn product is required. For this purpose, the apparatus for producing a sewn product includes a cross cutter in the region of the end which is directed away from the supply device. The longitudinal rims of the sewn product material are cut by means of longitudinal cutters.

The cross cutter is arranged on a further sewing device that is movable on guide rails transversely to the conveying direction of the sewn product material. The sewing device consists of a sewing unit including two, preferably four needles and an oscillating shuttle box which is arranged below the sewing unit and includes shuttles which are assigned to the needles. On the shuttle box a cutting device in the form of a rotary knife is provided, by means of which the sewn product material is cut. The sewing unit, the cutting device and the shuttle box are arranged in a C-shaped housing which is movable along the guide rails.

Based on this prior art, it is an object of the present invention to provide a method of the type as mentioned and an apparatus of the type as mentioned, by means of which sewn products with corner areas deviating from an orthogonal pattern may be formed in an easy and inexpensive way.

On part of the method according to the invention the solution provides that with a device at least one sub-area of a transition area of adjacent sewn products which is arranged in the conveying direction of the sewn product material is removed, this removal of the sub-area covering both sewn products which are adjacently arranged in the sewn product material and being performed prior to or during the stitching of the seams transversely to the conveying direction. On part of the apparatus according to the invention, the solution of the above-mentioned object provides that the apparatus additionally includes an arrangement, by which at least one sub-area of at least two sewn products that are adjacently arranged in the conveying direction of a sewn product material is removed.

Accordingly, in the method of the invention it is provided that the sewn product material in the transition area of adjacent sewn products is processed by removing a sub-area. Removing a sub-area covers both sewn products that are adjacently arranged in the sewn product material and is performed prior to or during the stitching of the seams transversely to the conveying direction. Consequently, it is provided that at least one sub-area is removed from the sewn product material during the stitching of the seams transversely to the conveying direction of the sewn product material. Here, the time of this sewing operation is determined by a step of the method which begins with the positioning of the sewing device in the region of a lateral edge of the sewn product material running in the conveying direction and ends with the termination of the return of the sewing device to the initial position. Therefore, during this step of the method at least two stitched seams are made in the sewn product material at right angles to the conveying direction of the sewn product material between which the sewn product material is cut by means of a cutting device, so that a sewn product which is arranged on the end side in the sewn product material is separated from the sewn product material and passed on for further processing.

Alternatively, it may be provided that the sub-area is removed spatially and/or temporally before the stitching of the seams transversely to the conveying direction of the sewn product material. For the event that several sub-areas have to be removed, it may be provided that the removal of the subareas is performed both during the stitching of the seams transversely to the sewn product material and prior to the stitching of the seams transversely to the sewn product material. Further, there is an option to remove the sub-areas prior to stitching the seams transversely to the conveying direction, if the stitching of the seams transversely to the conveying direction is effected bi-axially, meaning that the sewing device needs not be returned again to the initial position before stitching the seams transversely to the conveying direction.

According to a feature of a further development of the invention it is provided that the sub-area is removed in a cutting operation. Scissors or knives proved satisfactory for this purpose. An alternative further development of the method according to the invention provides that the sub-area is removed by punching. The removal of the sub-area by punching is possible with a high degree of accuracy and above all with a high punching speed. Of course, there is also an option of removing sub-areas by punching and cutting.

Preferably, two sub-areas which are spaced from each other in the conveying direction of the sewn product material are removed at the same time. Therefore, the possibility exists for example that two sub-areas in the region of one longitudinal edge are removed simultaneously, while in the region of the opposite longitudinal edge of the sewn product material sub-areas to be removed are removed during the sewing operation. This makes sure, that during the sewing operation in the region where the seams are stitched transversely to the conveying direction of the sewn product material only one sub-area must be removed, so that the time interval for the removal of the sub-area may be easily matched with the period which is required for the sewing operation. Consequently, the removal of the sub-areas may be effected within a period which is shorter compared to the period required for the sewing operation. Any reduction of the processing speed of the sewn product material is not caused thereby.

According to a further feature of the invention it is provided that two sub-areas on opposite lateral rims in the region of the stitched seams are removed transversely to the conveying direction of the sewn product material. In this embodiment it is provided that the subareas are arranged in such a way that each sewn product deviates from an orthogonal pattern in the corner regions.

Preferably, the two sub-areas on the opposite lateral rims are spatially and/or temporally removed substantially simultaneously. This technique turned out to be advantageous particularly in a case where the sub-areas are removed temporally prior to the stitching of the seams transversely to the conveying direction of the sewn product material. Controlling the removal of the sub-areas takes place in this case by the determination of the conveying distance of the sewn product material, so that the removed sub-areas are arranged in a region of the sewn product material in which thereafter the seams are stitched transversely to the conveying direction of the sewn product material.

Furthermore, it turned out to be advantageous to remove substantially simultaneously with the sewing operation at least one sub-area which is arranged at a distance from for instance at least one sewn product in the sewn product material, especially by the distance of a whole-number pattern repeat. This technique results in that the sewn product material is fed to the sewing device with the sub-areas already separated, so that the time flow of the production of the sewn products will not be slowed down by this fact either. Here, the distance is preferably set to the pattern repeat from one or several sewn products.

An alternative embodiment of the method according to the invention provides that one sub-area on a first lateral rim is removed during the stitching of the seams which run transversely to the conveying direction and that a second sub-area on a second lateral rim is removed during the return of the sewing unit to the initial position.

Accordingly, it is provided in this embodiment that for instance the sub-area in the region of the initial position of the sewing unit is removed directly after the beginning of the sewing operation transversely to the conveying direction of the sewn product material. The removal of this sub-area takes place at the moment in which the sewing unit has advanced up to a position which allows the removal of the sub-area in the region of the first lateral rim.

After the sewing unit has completely stitched the seams which run transversely to the conveying direction, the sewing is returned to its initial position. The period of return of the sewing unit is then utilized for removing the sub-area in the region of the second lateral rim of the sewn product material. To be able to perform the removal of the sub-areas with the required cutting or punching accuracy, it is provided that the sewn product material is maintained in a clamped condition transversely to the conveying direction not only during the sewing operation and the associated cutting operation transversely to the conveying direction of the sewn product material in the region of the two seams to be stitched transversely to the conveying direction of the sewn product material but also during the return of the sewing unit to the initial position.

According to a further feature of the invention it is provided that the sub-area is formed substantially as a triangle, preferably as an isosceles triangle. With this configuration, all of the four corner areas of the sewn product are processed in such a way that the lateral rims which run in the conveying direction and at right angles to the conveying direction of the sewn product material are formed with short diagonal lateral rims that connect the lateral rims of the sewn product which extend in the conveying direction and at right angles to the conveying direction under an angle which is formed to be identical with respect to the lateral rims.

Preferably, said sub-area includes two limbs which are oriented under an angle of <90° in the conveying direction, which limbs are formed in a convex pattern with respect to the sewn product. If for instance mattress panels are produced in this way, mattresses with rounded corners may be produced from such panels.

According to a further advantageous embodiment of the inventive method it is provided that that the sub-area is formed of two quadrant-shaped sections. This embodiment, too offers the advantage that with correspondingly formed sub-areas sewn products with rounded corners can be produced which may be used in the case of mattress panels for the production of mattresses having rounded corners.

For fixing the mattress panels for instance to an inner spring system it is provided that at least on the lateral rims of the sewn product material extending in the conveying direction a band-shaped sewing element is stitched to the sewn product material, which band-shaped sewing element is formed discontinuous in the region of the sub-areas. This interruption of the band-shaped sewing element may be achieved for instance by the fact that during the removal of the sub-area also the band-shaped sewing element is removed, especially by cutting or punching.

According to a further feature of the invention it turned out to be advantageous that the lateral rims of the sewn product material running in the conveying direction of the sewn product material are formed with a stitched seam before or after removing the sub-area. This stitched seam is an advantage especially in a case where the sewn product material consists of several layers, so that these several layers are sewn up with each other in the region of the lateral rims running in the conveying direction, whereby additional processing steps in the production of mattresses for instance are avoided.

According to a further feature of the invention it is provided that the sewn product material is withdrawn from a multiple needle sewing machine, especially a multiple needle chain stitch sewing machine or a multiple needle backstitch sewing machine and advanced to a sewing device.

The apparatus according to the invention is advantageously further developed by the fact that the sewing device includes at least two, especially four rows of needles and associated shuttles, by means of which at least two stitched seams can be made between two sewn products arranged adjacent to each other in the sewn product material, and by the fact that a cutting device is provided, by means of which the sewn product material is cut between said two stitched seams. Preferably, the cutting device and the sewing device include a common drive, so that the sewing operation can be leading compared to the cutting operation by a short time interval.

According to a further feature of the invention it is provided that the device is formed as a punch, scissors and/or knife, especially as a circular knife. With these devices the sub-areas may be removed from the sewn product material easily and especially within a short time.

In a preferred embodiment, the device includes two circular knives, of which the axes are oriented at right angles to each other. Preferably, the circular knives are adjustable concerning their mutual orientation, in order to be able to set different angles. According to a further feature, the axes of the circular knives are arranged in planes which are horizontally differently oriented. This offers the possibility that the circular knives are mutually oriented or aligned in a manner such that a first circular knife is arranged at a radial distance to the axis of the second circular knife which is slightly smaller than the radius of the second circular knife, whereby the advantage is obtained that the circular knives may be arranged in such a way that a reliable separation of the sub-area is possible.

According to a further feature of the invention it is provided that the device is formed as a punch including two substantially quadrant-shaped cutting lines, said cutting lines having a point of intersection. This device is particularly suited for the simultaneous removal of sub-areas of adjacent sewn products, said punching of the sewn product material allowing high-speed processing.

According to a further feature the device is adjustable of its distance to the sewing device, so that the device can be used for sewn products of different dimensions. In addition to that, due to the adjustability of the device, the device may be used in dependence of the conveying speed of the sewn product material.

An alternative to this is given by the fact that the sewing device includes an upstream supply device for the sewn product material. In this case, the device may be arranged in fixed fashion because different dimensions of the sewn products to be processed can be compensated by the supply device. According to a further feature of the invention this supply device is formed as a dancer roll.

Figure 2:
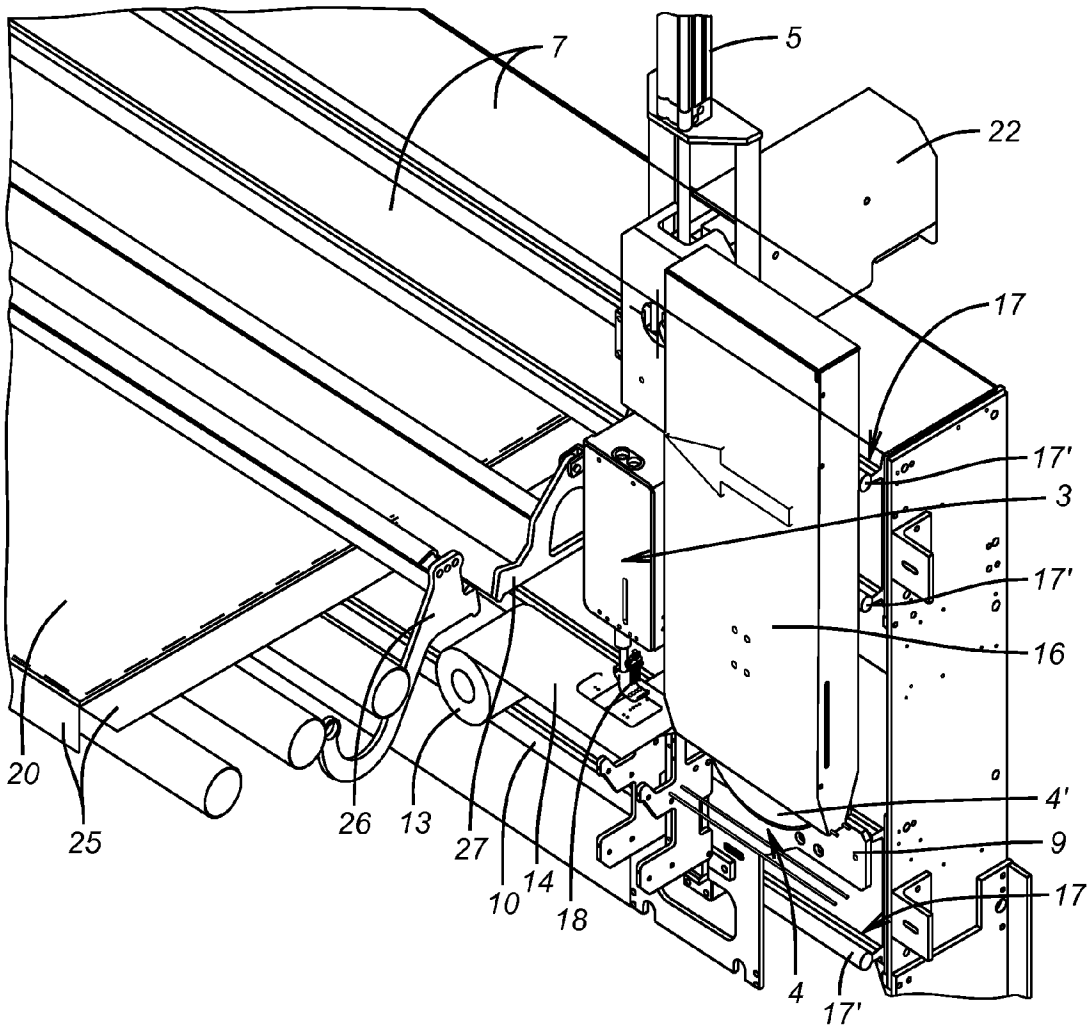
Figure 3:
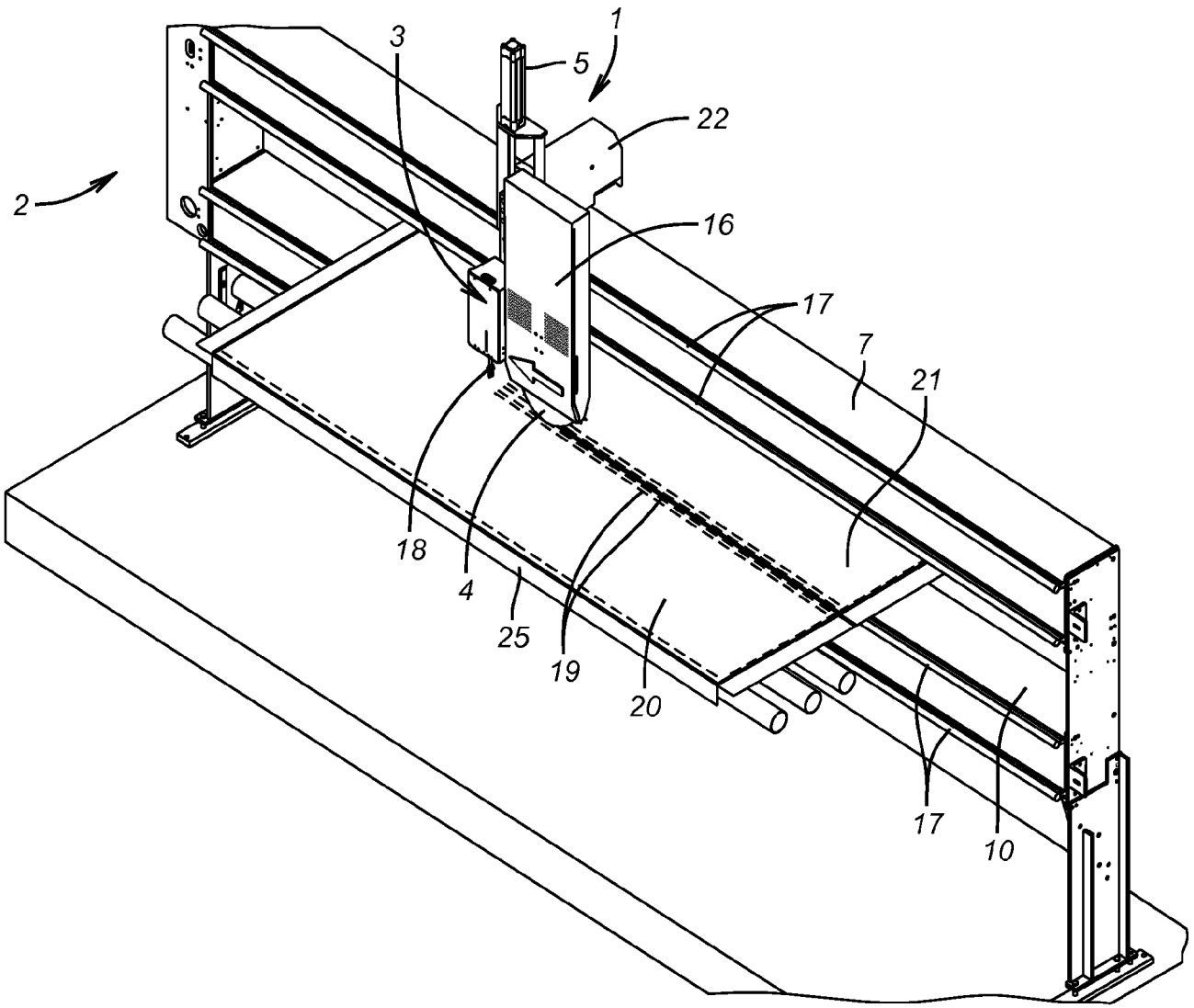
Figure 4:
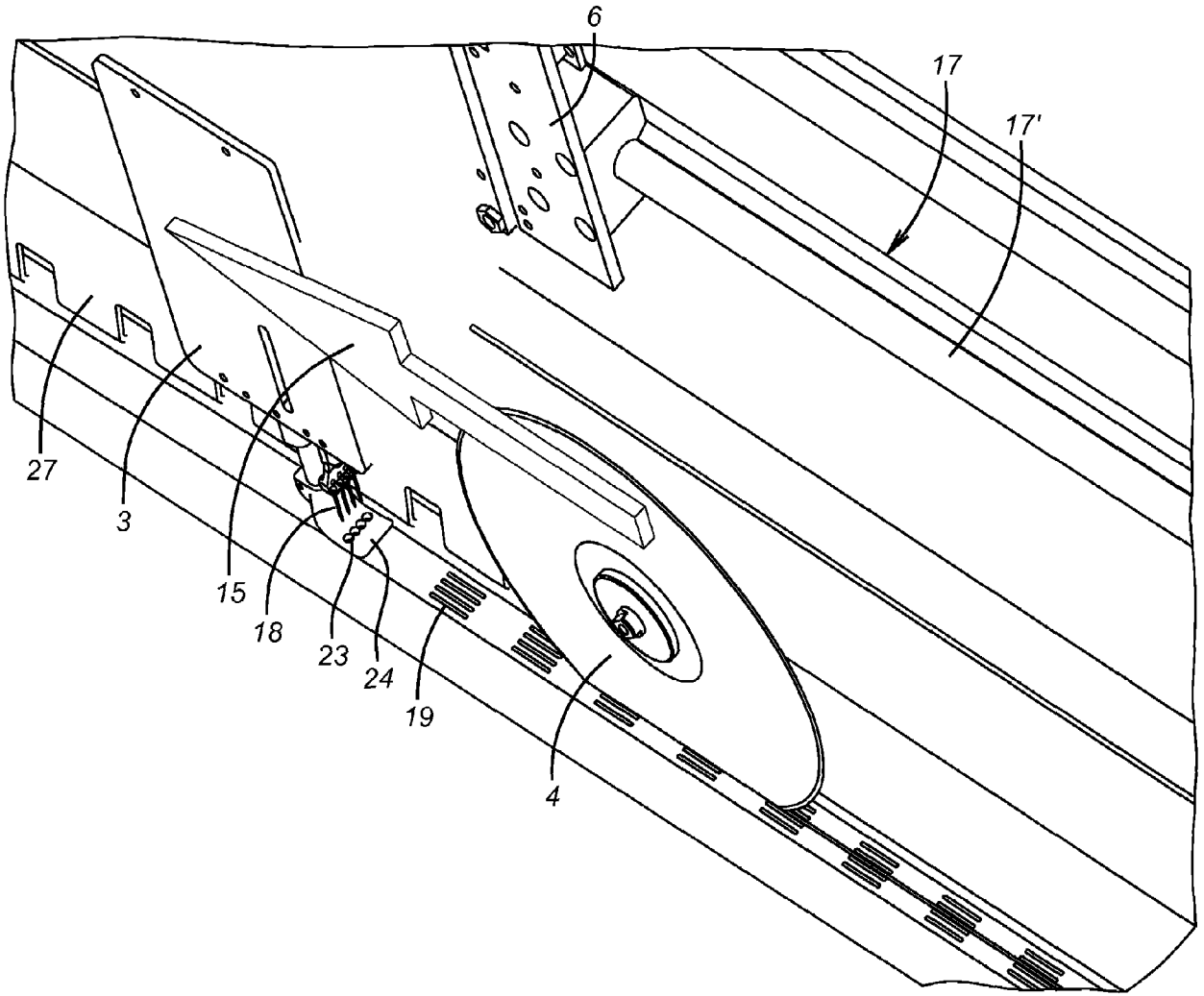
Figure 5:
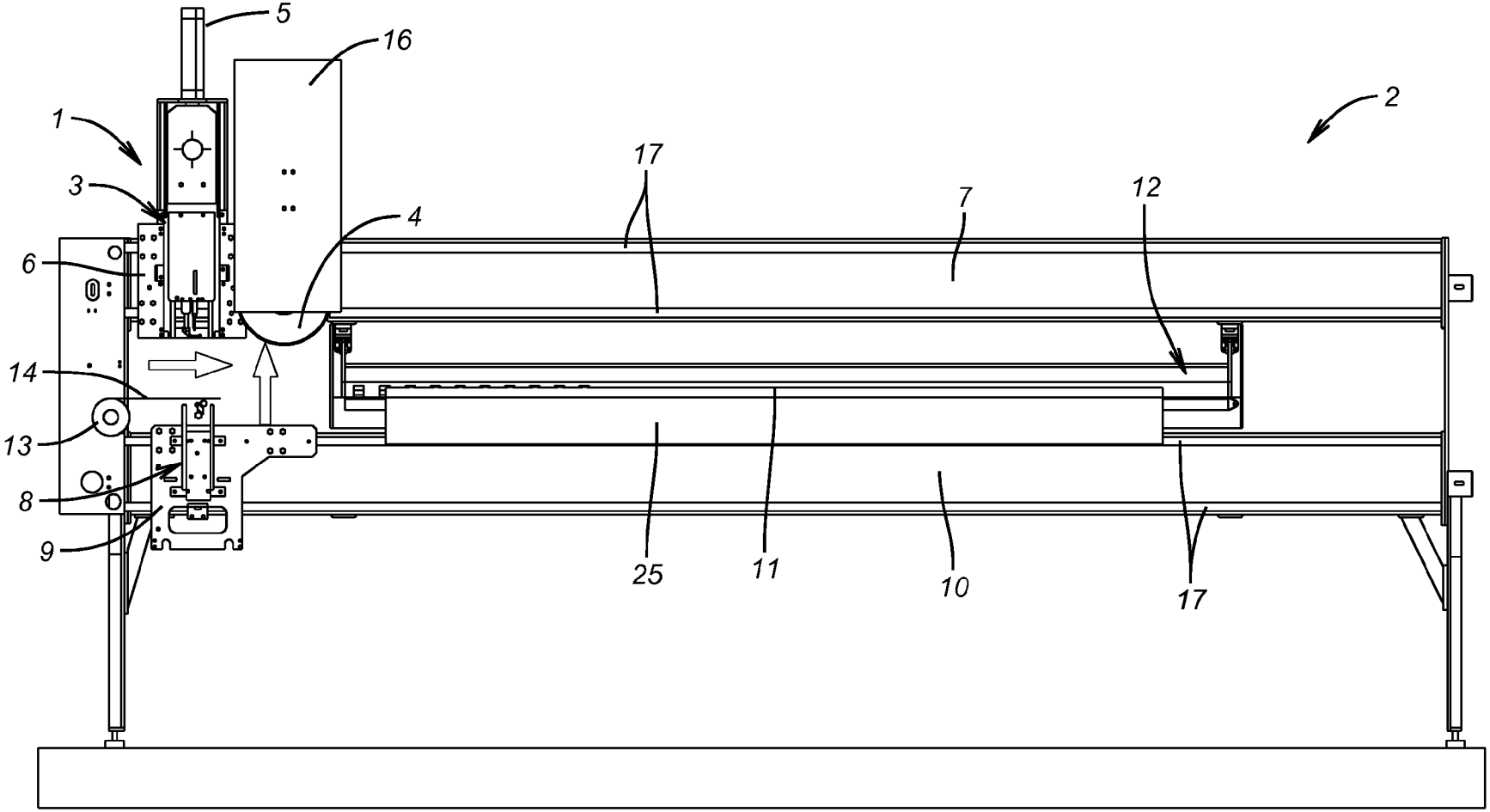
Figure 6:
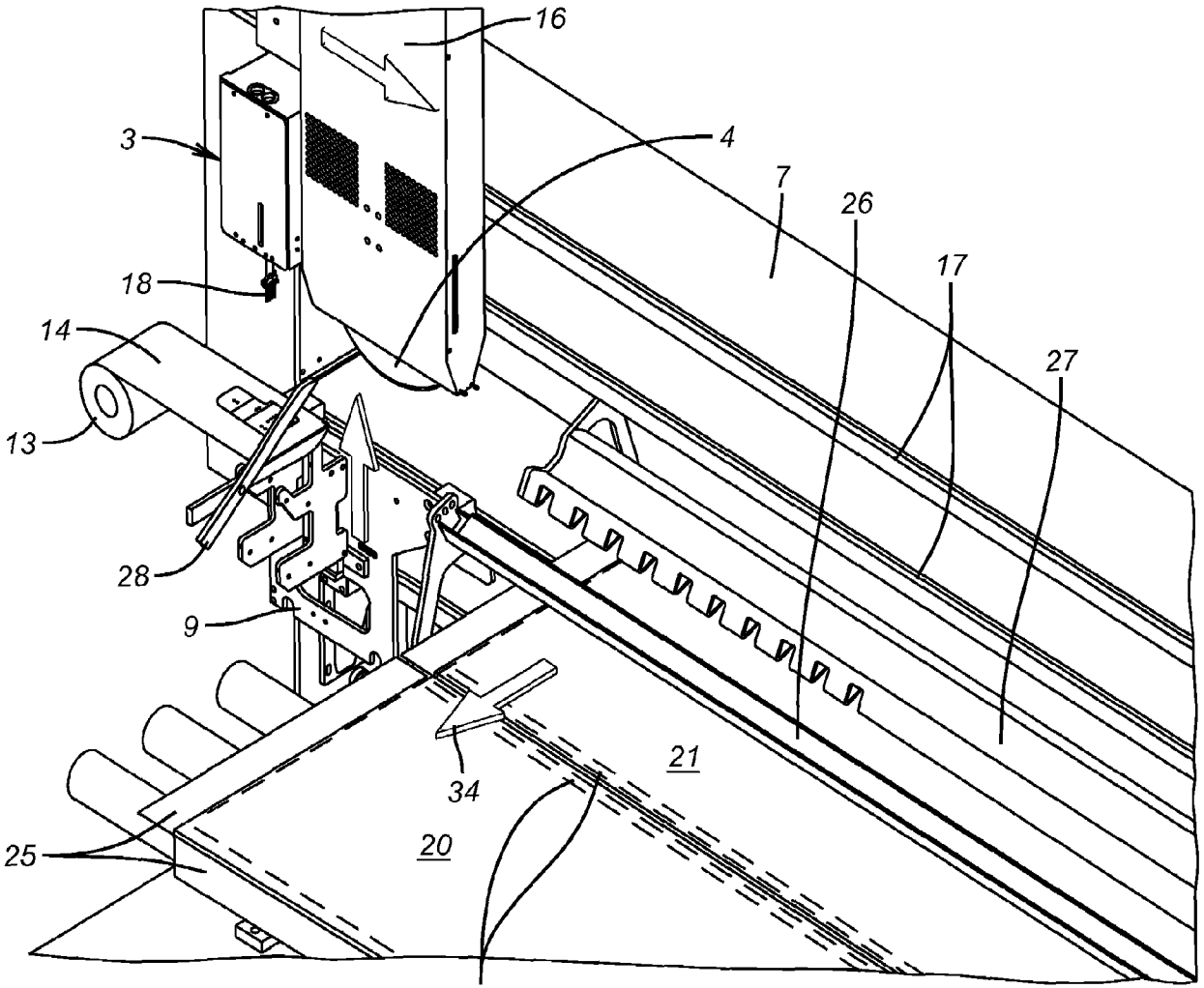
Figure 7:
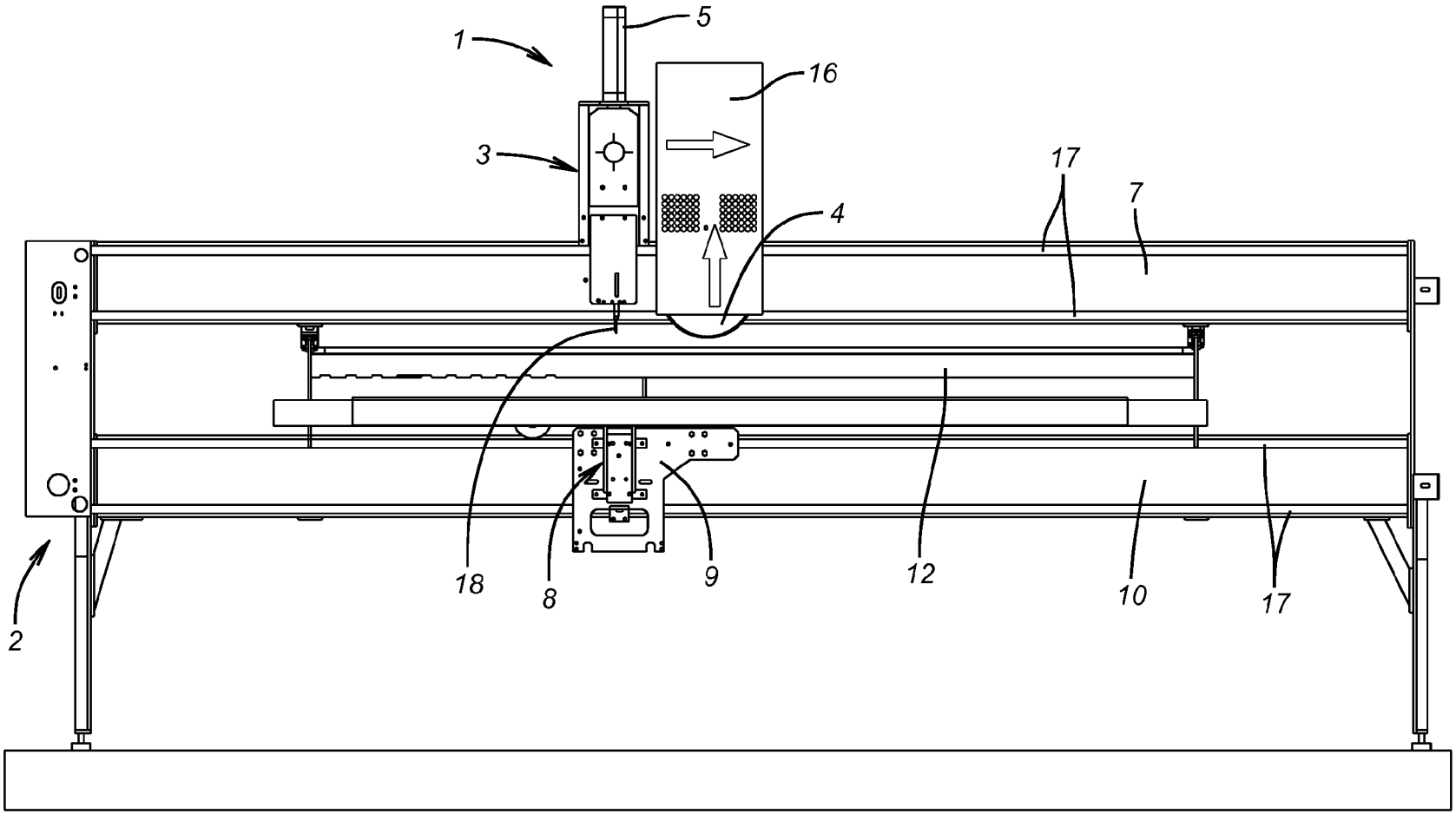
Figure 8:
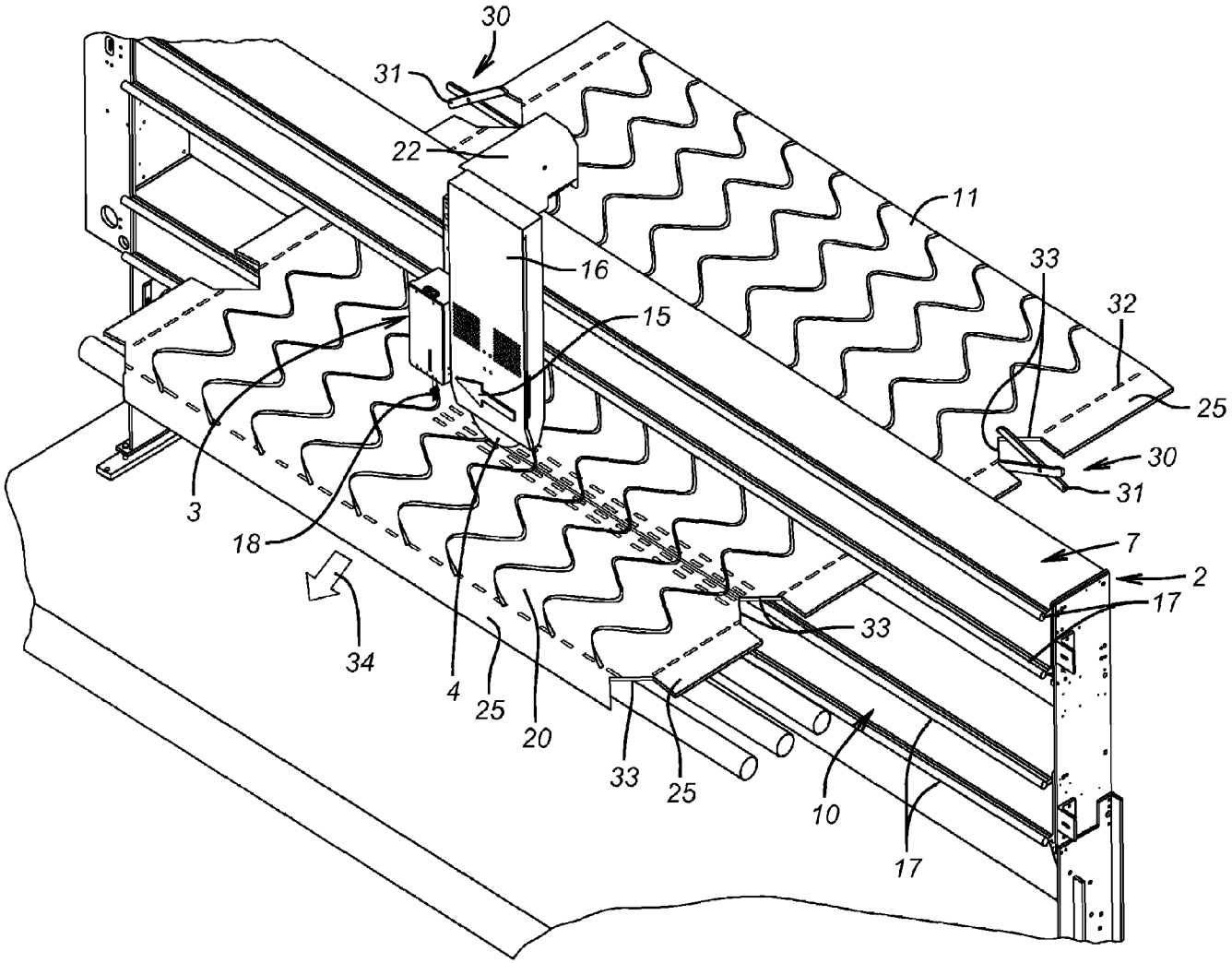
Figure 9:
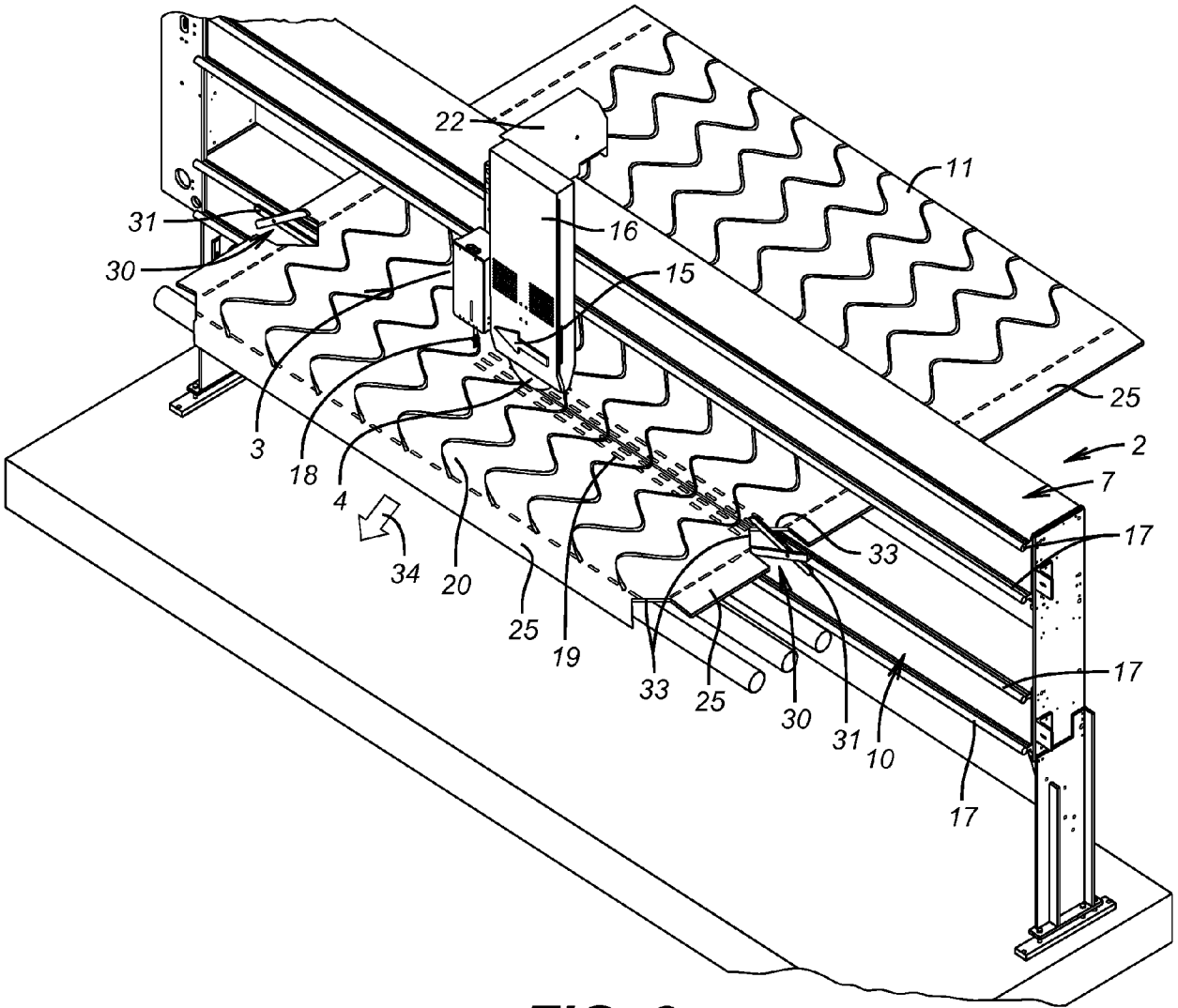
Figure 10:
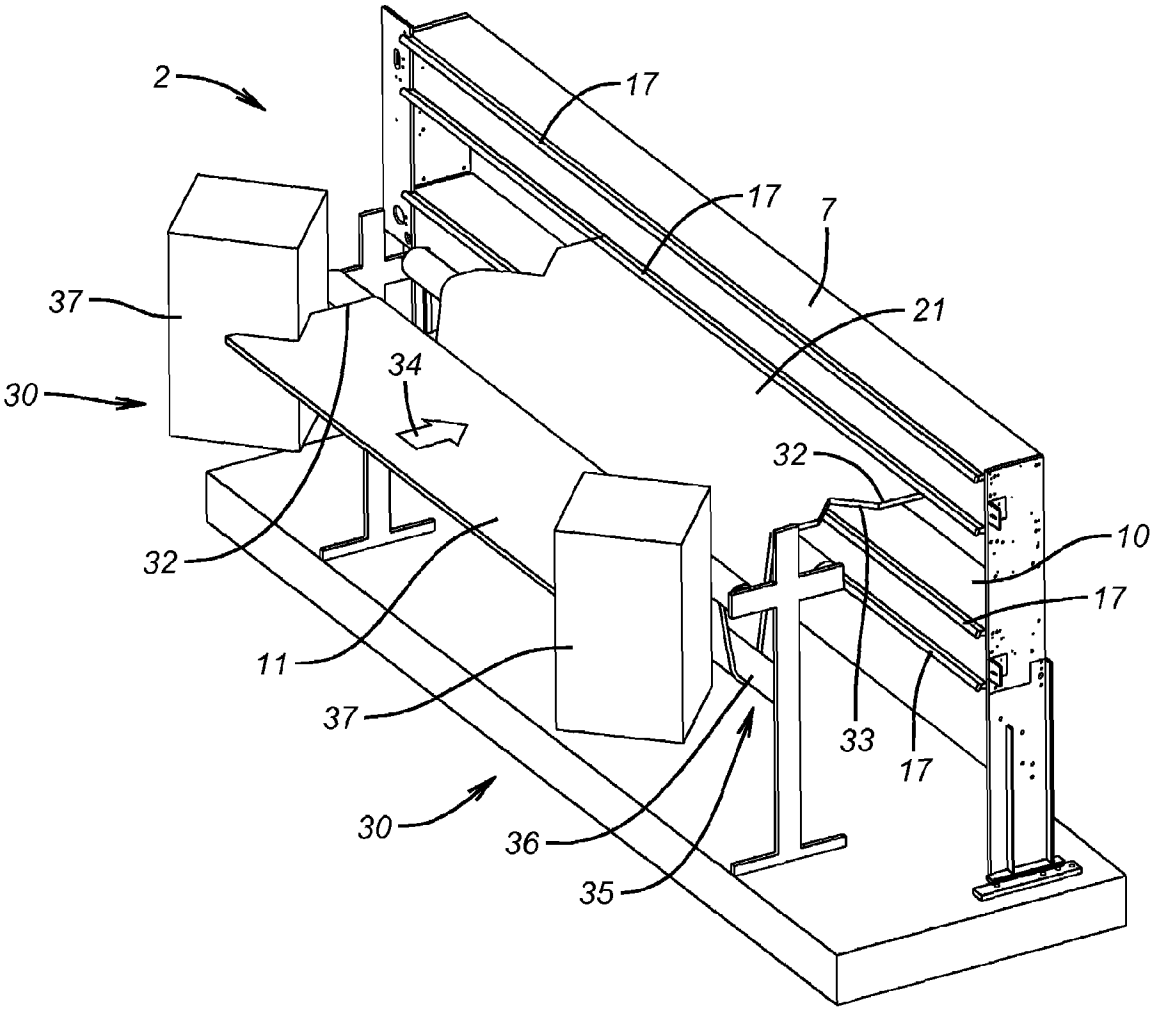
Figure 11:
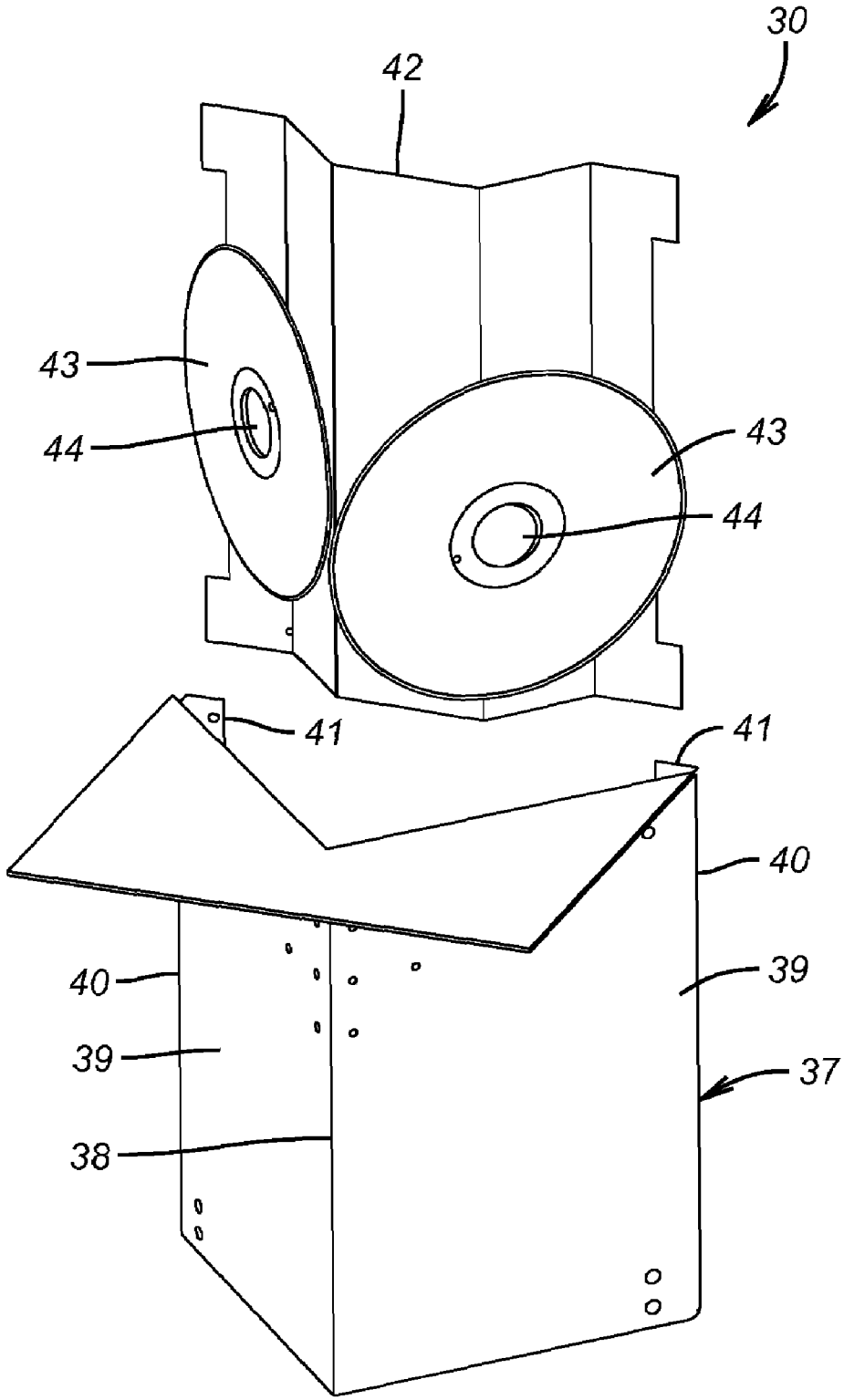

Further advantages and features of the invention will become apparent from the following description of one embodiment with reference to the drawing. In the drawing it is shown by:

FIG. 1 a front view of an embodiment of an apparatus for the production of a sewn product by means of the method according to the invention in an initial position;

FIG. 2 a perspective detailed view of the apparatus shown in FIG. 1;

FIG. 3 a perspective view of the apparatus of the FIGS. 1 and 2 in a working position;

FIG. 4 a perspective detailed view of the apparatus shown in FIG. 3;

FIG. 5 a front view of the apparatus according to the FIGS. 1 to 4 in an end position;

FIG. 6 a perspective detailed view of the apparatus shown in FIG. 5;

FIG. 7 a front view of the apparatus according to the FIGS. 1 to 6 during the returning movement to the initial position;

FIG. 8 a perspective view of an apparatus according to the FIGS. 1 to 7 including a first embodiment of a device for removing sub-areas of the sewn product material;

FIG. 9 a perspective view of an apparatus according to the FIGS. 1 to 7 including a second embodiment of a device for removing sub-areas of the sewn product material;

FIG. 10 a section of an apparatus according to FIG. 1 in a perspective view including a supply device and two devices for removing sub-areas of a sewn product material, and FIG. 11 a device for removing a sub-area of a sewn product material, in a perspective view.

In FIG. 1 an apparatus 2 for producing a sewn product 20, 21 (see FIG. 3) is illustrated, which apparatus has arranged thereon a sewing device 1 including a sewing unit 3, a shuffle box 8 and a cutting device 4. The sewing device 1 is in the initial position. In this initial position the sewing unit 3 and the cutting device 4 which is configured as a circular cutting wheel 4' are lowered, which lowering movement is effected in this embodiment by means of a drive 5 which is operated pneumatically. The sewing unit 3 and the cutting device 4 are fixed to a base plate 6 and are arranged on a guide device which is in the form of a traverse 7 which guarantees a stable and secure guidance. The shuttle box 8 is also fixed to a base plate 9 that is guided on a traverse 10 which extends parallel to the traverse 7. The traverses 7, 10 are connected on their ends to a portal 2 by a screwed connection. Between the traverse 7 of the sewing unit 3 and the traverse 10 of the shuttle box 8 a sewn product material 11 is arranged which during a sewing and cutting operation is clamped by means of a clamping device 12 which is constituted by two clamping elements 26, 27 (see FIG. 2). On the shuffle box 8 a supply device 13 for a band-shaped sewing element 14 is arranged, said supply device 13 being arranged ahead of the shuttle box 8 in the sewing direction according to arrow 15.

FIG. 2 shows a detailed view of the apparatus 2 illustrated in FIG. 1, wherein the cutting device 4 includes a housing 16 from which a part of the cuffing wheel 4' protrudes through a bottom-side opening. The housing 16 prevents that objects or body parts get into contact with the cutting wheel 4'. The traverses 7, include on the front side thereof facing the sewing device 1 rails 17 that extend in the longitudinal direction of said traverses and that include a rail head 17' having a circular cross section, with rolls being guided on said rails which are connected to the base plates 6, 9. There are provided two parallel extending rails 17 each for the sewing unit 3 and the shuttle box 8. In the illustrated initial position a piece of the band-shaped sewing element 14 is shown unrolled from the supply device 13 and positioned between the needles 18 of the sewing unit 3 and the shuttle box 8.

Further the drive 22 of the sewing unit 3 can be seen which drives the needles 18. In FIG. 2 sections 25 of the sewing element 14 can be seen which extend over the lateral rims of the sewn product 20, 21. In the production of mattresses, these sections 25 are connected to a mattress core and thus maintain the mattress panel permanently in its position.

The clamping device 12 consists of two clamping elements 26, 27 which clamp the sewn product material 11 in a stretched condition during the sewing and cutting operation, so that the sewing and cutting may be performed reliably and at a high speed.

In FIG. 3 the apparatus 1 of the invention is illustrated in a further working position. Four stitched seams 19 are to be seen, with the cutting device 4 performing a cut in the sewn product material 11 in the center between the stitched seams 19, so that the rims of the sewn products 20, 21 are provided with two stitched seams 19. During the sewing operation the band-shaped sewing element 14 is simultaneously sewn to the sewn product material 11 from below and thereafter also cut by the cutting device 4, so that the rims of the sewn product 20, 21 are reinforced by this band-shaped sewing element 14.

FIG. 4 shows a detailed view of the apparatus 2 illustrated in FIG. 3, wherein four needles 18 can be seen which are able to penetrate through four openings 23 in a presser foot 24.

In FIG. 5 the apparatus 2 of the invention is shown in an end position in which the sewing and cutting operation is concluded. The sewing unit 3 and the cutting device 4 are raised and can thus be returned to the initial position (FIG. 1) in a non-contacting state along the traverse 7. At the same time the shuttle box 8 is moved back to the initial position along the traverse 10.

FIG. 6 shows a detailed view of the apparatus 2 illustrated in FIG. 5. Here it can be seen that the clamping elements 26, 27 are opened at the end of the sewing and cutting operation, so that simultaneously with the returning of the sewing unit 3, the shuffle box 8 and the cutting device 4 to the initial position according to FIG. 1 the sewn product material 11 can be advanced, in order to begin a next working cycle. In FIG. 6 there is further shown an additional cuffing device 28, by means of which the band-shaped sewing element 14 is cut-off at the end of the sewing and cuffing operation.

FIG. 7 shows the apparatus 2 of the invention which is returned to the initial position according to FIG. 1.

The method according to the invention of producing a sewn product begins with the step that sewn product material 11 is advanced to the sewing and cuffing zone and, in the process thereof, is withdrawn from a multiple needle sewing machine, while the longitudinal sides of the sewn product material that run parallel to the conveying direction are simultaneously sewn up. Additionally, a band-shaped sewing element 14 may be sewn to the longitudinal sides which is not sewn up over the whole area thereof, so that a free section 25 runs along one longitudinal side 25 of the sewn product material 11. At this point of time the sewing unit 3 and the cuffing device 4 are in their raised position.

To avoid that the sewn product material 11 falls into a gap or is redirected to this gap which is formed in the conveyor device; a support element is moved over the gap by means of a lever device during the conveyance of the sewn product material 11. Positioned on the upper side of the supporting element is a signal element which signals to the sewing device 1 a rim portion of the sewn product material 11 at which the sewing operation and the subsequent cutting operation should be started. After this signalisation the gap is exposed again by withdrawing the supporting element. The sewing device 1 simultaneously moves to its initial position (FIG. 1) in which the sewing device 1 starts working, namely sewing and thereafter cutting.

To this end, the sewing unit 3 and the cutting device 4 are lowered by means of a drive 5 until contacting the sewn product material 11. In a next step the sewing device 1 is moved along the traverses 7, 10 in the sewing direction according to arrow 15, whereby the layers of the sewn product material are sewn up. At the same time the band-shaped sewing element 14 is pulled off from a supply device 13 and is sewn up with the sewn product material 11 from below. During its movement along the traverse 7 the sewing unit 3 is followed by the cutting device 4 which cuts the sewn product material 11 between the stitched seams 19, so that individual sewn products are formed. The band-shaped sewing element 14 has such a width that it is not sewn up over the full area thereof, so that free sections 25 are arranged also on the transverse rims of the sewn product material 11. During this sewing and cutting operation the sewing unit 3 and the shuffle box 8 are mutually synchronized with respect to their movement along the corresponding traverses 7, 10 in such a way that the needles 18 and shuttle 8 will reliably cooperate, with the cutting device 4 being moved jointly with the sewing unit 3. If the sewing device 1 has arrived at its final position, the sewing unit 3 and thereafter the cutting device 4 will be moved to a raised position, so that a next piece of sewn product material 11 may be advanced to the working zone, after the previously finished sewn product 20, 21 is removed from the sewing and cutting zone. Thereafter, the sewing device 1 moves back to its initial position, so that a next piece of the sewn product material 11 may be processed, namely a next sewn product 20, 21 be produced.

In FIG. 8 a first embodiment of a device 30 for removing sub-areas of the sewn product material is shown and indicated by two scissors 31. The first embodiment of the device 30 is arranged upstream of the apparatus 2 in the conveying direction according to an arrow 34 in FIG. 8, so that the device 30 removes the sub-areas from the sewn product material by cutting, before the sewn product material is provided with stitched seams 19 transversely to the conveying direction according to arrow 34 and is separated by cutting in individual sewn products 20

As an alternative to the removal of the sub-areas by cutting, also a removal of the sub-areas by punching may be provided.

With the device 30 two sub-areas on opposite lateral rims 32 of the sewn product material 11 are removed at the same time, with the lateral rims 32 running parallel to the conveying direction according to arrow 34. The removed sub-areas additionally cover the sections 25 which extend parallel to the lateral rims 32.

Differently from this embodiment the second embodiment according to FIG. 9 provides that the sub-areas are removed shortly before or during the separation of the sewn product material 11 in individual sewn products 20, wherein for separating the sewn product material 11 a sewn product 20 is separated from the sewn product material 11 by the apparatus 2.

Here, the configuration of the device 30 according to FIG. 3 substantially corresponds to the configuration of the device according to FIG. 8. This, however, is arranged in the region of the apparatus 2 in the conveying direction according to arrow 34.

Therefore, in the embodiment according to FIG. 9 it is provided that in a first step and with the apparatus being in a position as illustrated in FIG. 1, a sub-area is removed in the region of the lateral rim 32 remote from the cuffing element by means of the device 30, while at the same time the sewn product material 11 is provided with stitched seams 19 transversely to the conveying direction according to arrow 34. The removal of this first sub-area under the formation of the limbs 33 is finished by the time of the completion of the stitched seams 19.

After a part of these seams 19 is stitched and after especially the region of the second lateral rim 32 is released, the second sub-area on the second lateral rim 32 is removed. In this way of proceeding, both oppositely formed sub-areas are removed in a time-shifted fashion, but the removal of both sub-areas in the region of both lateral rims 32 will be completed by the time of the completion of the stitched seams 19 in the sewn product material 11 under simultaneous separation of a sewn product 20.

In the FIGS. 10 and 11 a further embodiment of a device 30 for removing a sub-area of a sewn product material 11 is shown. The embodiment according to FIG. 10 is substantially the same as the embodiment shown in FIG. 8, however in FIG. 10 the entire sewing unit 3 is not illustrated supplementary but is provided corresponding to FIG. 8. Moreover, corresponding to arrow 34, the conveying direction in the apparatus 2 according to FIG. 10 is directed in the opposite sense compared to the conveying direction of the apparatus 2 according to FIG. 8.

The apparatus 2 has arranged an upstream supply device 35 which includes a dancer roll 36 over which the sewn product material 11 is passed. Before the supply device 36 two devices are disposed in the region of the lateral rims 32 of the sewn product material 11, of which only one of their respective casings 37 is illustrated and which are shown in detail in FIG. 11. With these devices 30 the V-shaped sub-areas in the region of the lateral rims 32 are cut out from sewn product material 11.

In FIG. 11 the device 30 is shown in detail. The casing 37 consists of two plate elements 39 which are connected to each other in the region of a longitudinal edge at right angles to each other or which are integrally formed, said plate elements 39 having in the region of their free edges 40 two guide elements 41 which are angled in a direction towards each other. Along these guide elements 41 a retaining plate 42 is supported for sliding movement, and two circular knives 43 are arranged and driven for rotation on the retaining plate 42. The rotary knives 43 are driven for rotation about axes 44 which are arranged in horizontally differently oriented planes, wherein in FIG. 11 the axis 44 of the rotary knife 43 shown on the right side is arranged below the axis 44 of the rotary knife 43 shown on the left side in FIG. 11. Further, it can be seen that the rotary knives are mutually oriented in such a way that a first rotary knife 43 is arranged at a radial distance to the axis 44 of the second rotary knife 43, which distance is slightly smaller than the radius of the second rotary knife 43, so that the cutting edges of the rotary knives are slightly overlapping.

The above-described embodiments are merely for illustrating the invention and are not in any sense limiting.

LIST OF REFERENCE NUMBERS

1 sewing device
2 apparatus
3 sewing unit
4 cutting device
4' cutting wheel
5 drive
6 base plate
7 traverse
8 shuttle box
9 base plate
10 traverse
11 sewn product material
12 clamping device
13 supply device
14 sewing element
15 arrow
16 housing
17 rail
17' rail head
18 needles
19 stitched seam
20 sewn product
21 sewn product
22 drive
23 opening
24 presser foot
25 section
26 clamping element
27 clamping element
28 cutting device
30 device
31 scissors
32 lateral rim
33 limb
34 arrow
35 supply device
36 dancer roll
37 casing
38 longitudinal edge
39 plate
40 longitudinal edge
41 separating element
42 retaining plate
43 circular knife
44 axis

The invention claimed is:

1. A method for producing a mattress panel or a quilt having corner areas which deviate from an orthogonal pattern, the mattress panel or quilt having several layers of sewn product material stitched together, in which method the sewn product material is provided with at least two stitched seams between two sewn products that are arranged adjacent to each other in the sewn product material, the method comprising sewing the at least two stitched seams between the two sewn products by moving a sewing device transversely to the conveying direction of the sewn product material, cutting the sewn product material between the two stitched seams, wherein the sewing device includes a sewing unit with needles and a shuttle box including shuttles which are assigned to the needles, and removing, prior to or during the stitching of the seams, at least one sub-area of a transition area of adjacent sewn products arranged in the conveying direction of the sewn product material wherein the removal of the sub-area covers both sewn products that are adjacently arranged in the sewn product material.

2. The method according to claim 1, further comprising removing by cutting the sub-area.

3. Method according to claim 1, characterized by simultaneously removing two sub-areas which are spaced apart from each other in the conveying direction of the product material.

4. Method according to claim 1, characterized by removing two sub-areas on opposite lateral rims of the product material.

5. Method according to claim 4, characterized by simultaneously removing the two sub-areas on the opposite lateral rims.

6. Method according to claim 1, characterized by removing substantially at the same time with the sewing operation at least one sub-area which is arranged in the sewn product material at a distance from the sewing unit for at least one sewn product.

7. Method according to claim 6, in which the distance includes a one pattern repeat in at least one sewn products.

8. Method according to claim 6, where the distance is a whole-number pattern repeat to one or more sewn products.

9. Method according to claim 4, characterized by removing at least one sub-area on a first lateral rim during the stitching of the seams running transversely to the conveying direction, and removing the second sub-area on the second lateral rim during the return of the sewing device to an initial position.

10. Method according to claim 4, characterized by forming a triangle in said sub-area.

11. Method according to claim 10, wherein the base angles of the triangle each measure less than 90°.

12. Method according to claim 10, wherein the sub-area forms two quadrant-shaped sections.

13. Method according to claim 10, where the triangle is an isosceles triangle.

14. Method according to claim 1, characterized in that at least to the lateral rims of the product material running in the conveying direction sewing a band-shaped sewing element formed to be discontinuous in the region of said sub-areas.

15. Method according to claim 1, characterized in forming the lateral rims of the sewn product material running in the conveying direction with a stitched seam prior to or after the removal of said sub-areas.

16. Method according to claim 1, comprising removing the sewn product material from a multiple sewing machine and feeding it to a sewing device.

17. Method according to claim 16, where the multiple sewing machine is a multiple needle chain stitch sewing machine.

18. Method according to claim 16, where the multiple sewing machine is a multiple needle backstitch sewing machine.

19. Method according to claim 1, comprising removing at least two sub-areas approximately simultaneously during a sewing operation.

20. Method according to claim 1, characterized in that the mattress panel or the quilt consists of several layers of product material which are to be stitched together, as a segment of a product material.

21. A multiple needle sewing machine for producing a mattress panel or a quilt, having corner areas which deviate from an orthogonal pattern, from several layers of sewn product material which are to be stitched together, as a segment of a product material, said multiple needle sewing machine comprising a sewing device which is movable transversely to the conveying direction of the product material and which includes a sewing unit with needles and a shuttle box with shuffles assigned to the needles, and a device, by which at least one sub-area is removed from at least two sewn products adjacently arranged in the conveying direction of two product materials.

22. A multiple needle sewing machine according to claim 21, characterized in that the sewing device includes two rows of needles and associated shuttles, of which at least two seams are stitched between two sewn products which are adjacently arranged in the product material, and that a cutting device is provided, by which the product material is cut between the two stitched seams.

23. A multiple needle sewing machine according to claim 22, comprising a cutting device and a sewing device which share a common drive.

24. A multiple needle sewing machine according to claim 22, in which scissors and/or a knife forms the cutting device.

25. Method according to claim 24, where the knife is a circular knife.

26. A multiple needle sewing machine according to claim 22, with a cutting device comprising two circular knives, of which the axes are oriented at right angles to each other.

27. A multiple needle sewing machine according to claim 26, comprising circular knives with axes that are arranged in horizontally differently oriented planes.

28. A multiple needle sewing machine according to claim 26, comprising circular knives wherein the radial distance of the first knife to the axis of the second knife, is less than the radius of the second knife.

29. A multiple needle sewing machine according to claim 21, characterized in that the device is adjustable of its distance to the sewing device.

30. A multiple needle sewing machine according to claim 21, characterized in that the sewing device has arranged on the upstream side thereof a supply device for the product material.

31. A multiple needle sewing machine according to claim 30, characterized in that the supply device receives a number of sewn products between the device and the sewing device.

32. Method according to claim 31, where the supply device includes a dancer roll.

* * * * *